US008394004B2

(12) United States Patent
Towley, III et al.

(10) Patent No.: US 8,394,004 B2
(45) Date of Patent: Mar. 12, 2013

(54) SELECTORIZED DUMBBELL WITH SELECTOR COMPRISING WEIGHT CONNECTING PINS CARRIED IN EACH END OF HANDLE

(75) Inventors: Carl K. Towley, III, Alexandria, MN (US); Gregory S. Olson, Owatonna, MN (US)

(73) Assignee: PowerBlock Holdings, Inc., Owatonna, MN (US)

( * ) Notice: Subject to any disclaimer, the term of this patent is extended or adjusted under 35 U.S.C. 154(b) by 137 days.

(21) Appl. No.: 12/819,728

(22) Filed: Jun. 21, 2010

(65) Prior Publication Data

US 2011/0312475 A1 Dec. 22, 2011

(51) Int. Cl.
*A63B 21/075* (2006.01)

(52) U.S. Cl. ..... 482/107; 482/108

(58) Field of Classification Search ..... 482/92, 482/93, 94, 98, 104, 105, 106, 107, 108, 482/109, 148, 908; D21/681
See application file for complete search history.

(56) References Cited

U.S. PATENT DOCUMENTS

| | | | | |
|---|---|---|---|---|
| 5,637,064 | A | 6/1997 | Olson et al. | |
| 5,769,762 | A | 6/1998 | Towley, III et al. | |
| 6,186,928 | B1 * | 2/2001 | Chen | 482/107 |
| 6,196,952 | B1 * | 3/2001 | Chen | 482/107 |
| 6,322,481 | B1 * | 11/2001 | Krull | 482/107 |
| 7,264,578 | B1 * | 9/2007 | Krull | 482/108 |
| 7,520,845 | B2 | 4/2009 | Towley, III et al. | |
| 7,578,771 | B1 | 8/2009 | Towley, III et al. | |
| 7,850,581 | B2 * | 12/2010 | Towley et al. | 482/108 |
| 7,857,735 | B2 * | 12/2010 | Towley et al. | 482/107 |
| 7,918,772 | B2 * | 4/2011 | Towley et al. | 482/107 |
| 2005/0233873 | A1 * | 10/2005 | Chen | 482/107 |
| 2006/0234843 | A1 * | 10/2006 | Chen | 482/107 |

* cited by examiner

*Primary Examiner* — Stephen Crow
(74) *Attorney, Agent, or Firm* — James W. Miller

(57) ABSTRACT

A selectorized dumbbell comprises a plurality of nested weights which have front and rear arrays of rails with the rails being vertically spaced from one another with a space beneath each rail. A handle is insertable into a gap between stacks of nested left and right weight plates. A selector comprises front and rear pin arrays in each end of the handle with the pins in these arrays being selectively movable in a horizontal direction into extended positions located in the spaces beneath the rails for coupling different weights to the handle. The pins in the arrays are movable into their extended positions by a single vertically movable member carried on a vertically rotatable shaft in the handle end or by a plurality of independently movable members in the handle end that are moved by a plurality of keys carried on a top side of the handle end.

17 Claims, 6 Drawing Sheets

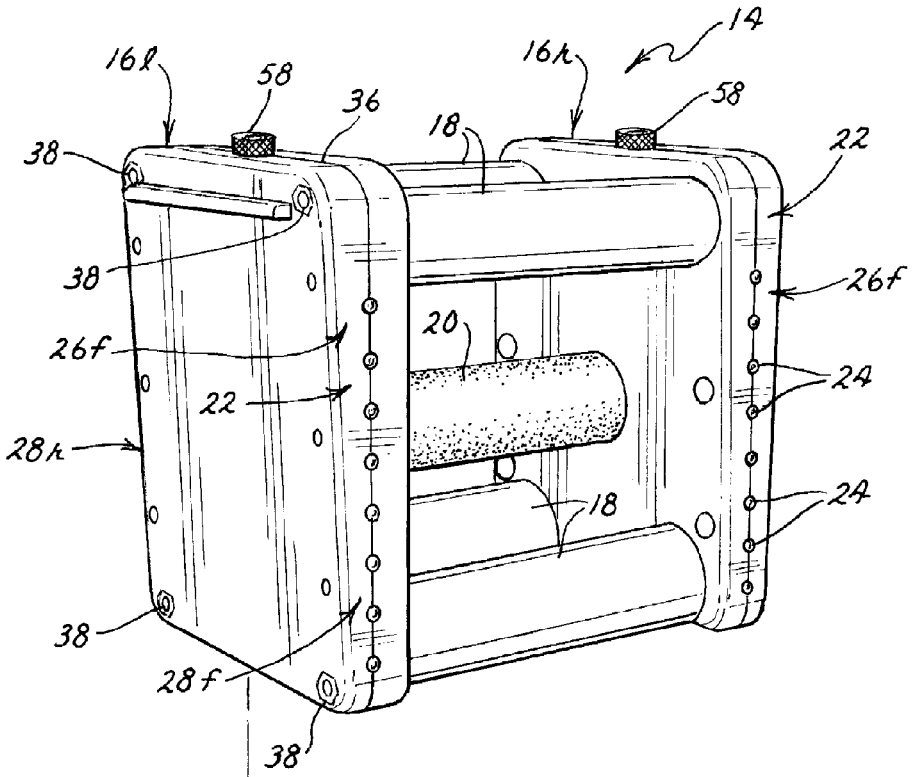
FIG. 2
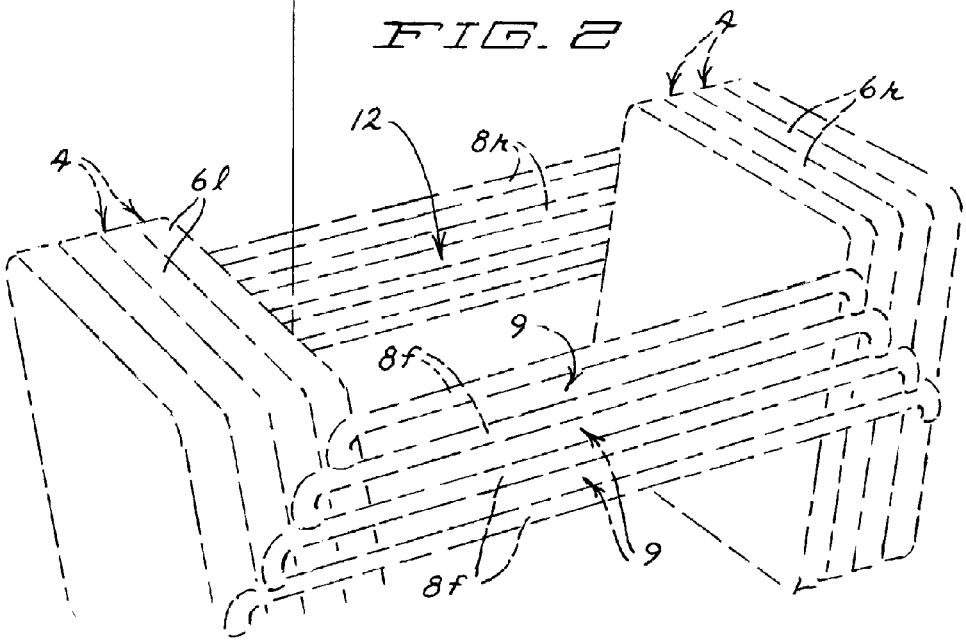

SELECTORIZED DUMBBELL WITH SELECTOR COMPRISING WEIGHT CONNECTING PINS CARRIED IN EACH END OF HANDLE

TECHNICAL FIELD

This invention relates to a selectorized dumbbell having a selector that adjusts how many weight plates from a stack of left weight plates and from a stack of right weight plates are selectively coupled to each end of a lifting handle of the dumbbell.

BACKGROUND OF THE INVENTION

The PowerBlock® is a well known selectorized dumbbell manufactured and sold by Power Block, Inc. of Owatonna, Minn. In such a dumbbell, various weights are provided that form a set of nested left weight plates and a set of nested right weight plates. The two sets of nested weight plates are laterally separated from one another by a space or gap. A handle can be inserted or dropped down into the gap to allow the handle to pick up a desired number of weight plates from each stack. The amount of the exercise mass provided by the selectorized dumbbell depends upon how many weight plates from each stack are coupled to each end of the handle by a selector.

In a traditional style of PowerBlock® selectorized dumbbell, each weight comprises a left weight plate that is joined to a corresponding right weight plate by a pair of side rails. The side rails are connected at each end to one side of each weight plate. One side rail is connected to the front sides of the left and right weight plates. The other side rail is connected to the rear side of the left and right side plates.

The selector in the traditional style PowerBlock® selectorized dumbbell comprises a U-shaped pin that is selectively positioned beneath the side rails of any desired weight. When the selector is so positioned and the handle is lifted, the handle will carry with it the weight selected by the position of the pin along with all weights above the selected weight. The amount of the weight carried by the handle is adjusted by vertically repositioning the pin so as to insert the pin beneath a higher or lower side rail.

The use of an insertable pin is an effective selector for a selectorized dumbbell. However, the pin must be on hand to be effective. If it is lost, then no weights can be coupled to the handle until the pin is found or a replacement pin is purchased. While the pin is usually tethered to the handle to minimize the chances that the pin will be lost, the tether itself can get in the way of the user and can be bothersome to some users.

Accordingly, there is a need in the art for a selectorized dumbbell having a selector that is easy to use, that functions with a traditional style of PowerBlock® selectorized dumbbell as described above, and that is not capable of being lost or getting in the way of the user.

SUMMARY OF THE INVENTION

One aspect of this invention relates to a selectorized dumbbell which comprises an array of nested weights comprising a stack of nested left weight plates and a stack of nested right weight plates. A handle is provided having a left end and a right end with the handle ends extending substantially perpendicularly relative to a hand grip of the handle and with the handle ends also being disposed substantially parallel to the weight plates. A selector is provided for coupling selected numbers of left weight plates to the left end of the handle and selected numbers of right weight plates to the right end of the handle. The selector comprises a plurality of connecting pins carried on each of the left and right ends of the handle. The connecting pins on each handle end are vertically spaced apart from one another in a vertically spread apart pin array and are horizontally movable between a weight coupling position in which the connecting pins are extended outwardly relative to the handle ends and a weight uncoupling position in which the connecting pins are retracted inwardly relative to the handle ends.

Another aspect of this invention relates to a selectorized dumbbell which comprises a plurality of individual weights that can be nested together to provide a left stack of nested left weight plates and a right stack of nested right weight plates that are separated by a gap. A handle is provided having a hand grip extending along an axis with the handle further having opposite left and right ends joined to opposite ends of the hand grip with the left and right ends of the handle extending perpendicularly to the hand grip. The handle may be dropped down into the gap between the stacks of nested left and right weight plates with the left end of the handle being adjacent an innermost left weight plate in the left stack of weight plates and the right end of the handle being adjacent an innermost right weight plate in the right stack of weight plates. Each weight comprises a left weight plate and a right weight plate that are spaced apart but joined to one another by a front rail extending between front sides of the weight plates and a rear rail extending between rear sides of the weight plates. The weight plates and front and rear rails of each weight are separate and distinct from the weight plates and front and rear rails of the other weights and from the handle. The front and rear rails of any given weight are located at a substantially identical vertical elevation relative to one another with the front and rear rails of different weights being located at different vertical elevations relative to one another such that the front and rear rails of all the weights overlie one another in vertically spread apart front and rear rail arrays with a vertical space being provided underneath each rail in the rail arrays. The front and rear rails of each weight differ also differ in length from the front and rear rails of the other weights such that the weight plates of different weights are spaced apart at progressively greater distances. The different elevations and different lengths of the front and rear rails on different weights allow the left and right weight plates to be nested with respect to one another in their respective left and right stacks. A selector is provided that connects a desired number of weights to the handle. The selector comprises a front pin array and an identical rear pin array in each of the left and right ends of the handle. Each pin array has a plurality of connecting pins equal in number to the number of rails in the front and rear rail arrays. The pins are vertically spaced apart in each of the handle ends in a manner that matches the spacing of the vertical spaces in the rail array but with the pins being vertically offset relative to the vertical spaces such that the pins in the pin arrays are projectable out from the handle ends into the spaces under the rails in the rail arrays. The pins in each of the front and rear pin arrays are horizontally movable relative to the handle ends from a retracted position in which the pins are located inwardly relative to the handle ends to be clear of the spaces under the rails in the rail arrays to an extended position in which the pins are extended outwardly relative to the handle ends into the spaces under the rails in the rail arrays.

BRIEF DESCRIPTION OF THE DRAWINGS

This invention will be described more completely in the following Detailed Description, when taken in conjunction with the following drawings, in which like reference numerals refer to like elements throughout.

FIG. 2 is a perspective view of the dumbbell of FIG. 1, particularly illustrating the handle of the dumbbell having been lifted out of the gap between the stacks of left and right weight plates to better illustrate the handle;

DETAILED DESCRIPTION

Figure 1:
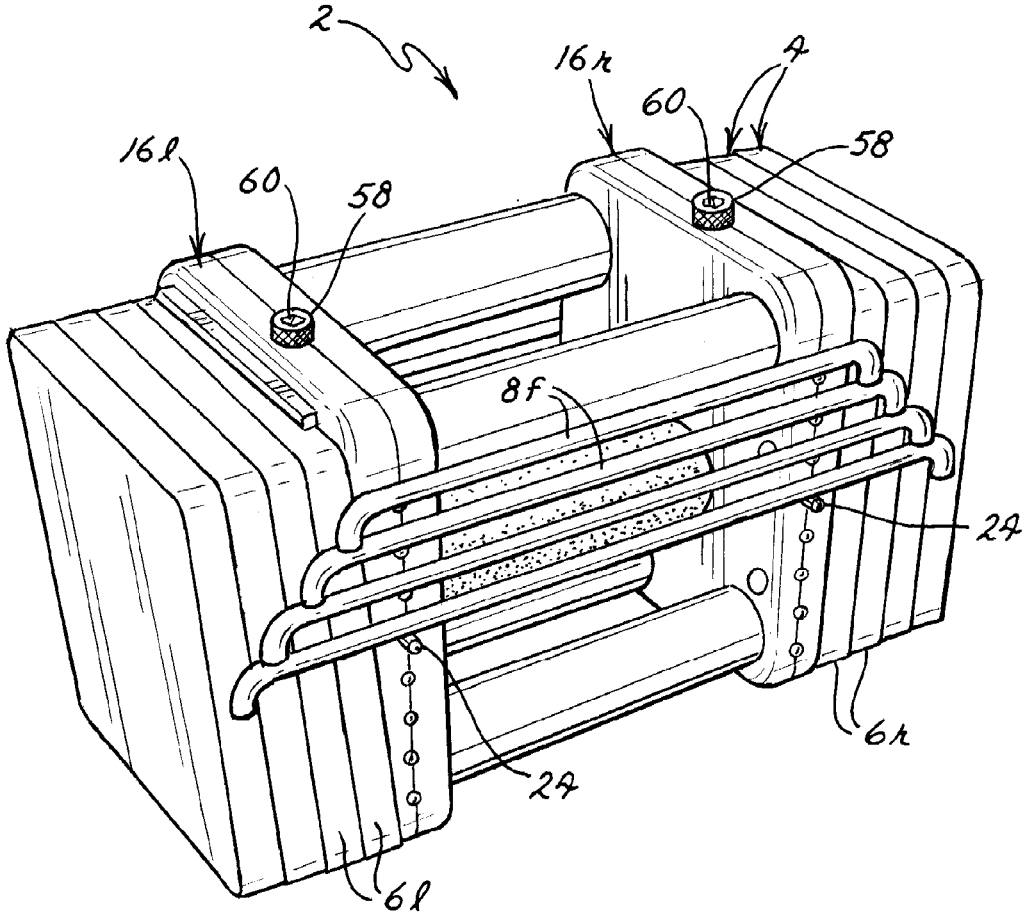
FIG. 1 is a perspective view of a first embodiment of a selectorized dumbbell according to this invention.

One embodiment of a selectorized dumbbell according to this invention is illustrated generally as 2 in FIG. 1. Dumbbell 2 is similar to the PowerBlock® line of dumbbells manufactured and sold by Power Block, Inc. of Owatonna, Minn. A typical PowerBlock® dumbbell is disclosed in U.S. Pat. No. 5,637,064, which is hereby incorporated by reference.

Dumbbell 2 incorporates a plurality of nested weights 4. Each weight 4 comprises a left weight plate **6*l*, a right weight plate 6*r*, and a pair of side rails 8 that hold weight plates 6 in a spaced apart orientation. Side rails 8 are welded to the front and rear sides of the pair of weight plates 6 that form one weight 4 at the same vertical height along the sides. For example, FIG. 1 depicts four front side rails 8*f* welded to the front sides of the paired weight plates 6 that comprise four different nested weights 4 with another four nested weights having been left out of FIG. 1 for the sake of clarity. There are identical rear side rails 8*r* welded to the rear sides of the paired weight plates 6 as best shown in FIG. 2**.

Weights 4 are nested in the sense that the left and right weight plates **6*l* and 6*r*, respectively, in each weight 4 are progressively spaced apart slightly further from one another. Thus, all of the left weight plates 6*l* are nested against one another in a lateral stack of nested left weight plates 6*l* and all of the right weight plates 6*r* are nested against one another in a lateral stack of nested right weight plates 6*r*. Obviously, to make this happen, side rails 8 used in each weight 4 in a set of weights 4 have progressively longer lengths. Side rails 8 used in the innermost weight will be the shortest with side rails 8 then becoming progressively longer as required to space weight plates 6 in the other weights 4 progressively further apart. This is shown in FIG. 1 by the progressively longer lengths of side rails 8** moving from top to bottom.

Referring now to FIG. 2, a gap 12 is provided between the stacks of nested left weight plates **6*l* and nested right weight plates 6*r*. A handle 14 can be dropped down into gap 12. Handle 14 is substantially the same as the handle disclosed in the 034 patent that has been incorporated by reference above. In other words, handle 14 has a pair of substantially vertical and substantially planar ends 16 that are laterally spaced apart by a distance that is slightly less than the width of gap 12. When handle 14 is inserted into gap 12, left end 16*l* of handle 14 is adjacent left weight plate 6*l* of the innermost weight 4 and right end 16*r* of handle 14 is adjacent right weight plate 6*r* of the innermost weight 4. The left and right ends 16*l* and 16*r* of handle 14 extend in planes that are substantially parallel to the planes in which the weight plates 6 themselves extend, e.g. inclined outwardly slightly by about 3° relative to vertical to aid in nesting weights 4** together.

Left and right ends **16*l* and 16*r* of handle 14 are joined together by an array of four cross tubes 18 that extend between and unite handle ends 16. A central hand grip 20 is contained within the array of cross tubes 18 and also extends between and unites handle ends 16 together. The user can insert his or her hand into handle 14 by dropping his or her hand down between the top two cross tubes 18 and can then grip hand grip 20 of handle 14 with that hand. The user can then raise or lower handle 14 by lifting or dropping hand grip 20. Hand grip 20, cross tubes 18, and handle ends 16 move together as a single unit. Hand grip 20 and cross tubes 18 extend along axes that are perpendicular to the planes in which handle ends 16** extend.

The major difference between handle 14 of this invention and that disclosed in the 034 patent lies in the nature of handle ends 16 and in a selector 22 that determines how many weights 4 are coupled to handle 14 for adjusting the exercise mass provided by dumbbell 2. In handle 14 of dumbbell 2 of this invention, selector 22 is permanently carried on handle ends 16 so that selector 22 can never be lost or misplaced apart from handle 14. As long as the user has handle 14, the user has selector 22 as well. Since it is not likely that handle 14 will ever be lost or kept apart from nested weights 4, it is then not likely that the user will ever be kept from using dumbbell 2 due to a lost selector 22. This is one advantage of the present invention. In using the term selector herein, the word selector is intended to refer to the entire mechanism that adjusts the exercise mass even though that mechanism in this instance comprises multiple components that are located on different portions of handle 14.

In handle 14 of this invention, selector 22 comprises a plurality of connecting pins 24 that are carried or housed within each end 16 of handle 14. On any given handle end 16, pins 24 are disposed in a front vertical array **26*f* and in a substantially identical rear vertical array 26*r*. Identical front and rear pin arrays 26*f* and 26*r* are contained within each end of handle 14, namely the front and rear pin arrays 26*f* and 26*r* contained in left end 16*l* of handle 14 are the same as the front and rear pin arrays 26*f* and 26*r* contained in right end 16*r* of handle 14. Thus, the description of the front and rear pin arrays 26*f* and 26*r* in that end of handle 14 whose interior is exposed and is visible in FIGS. 3 and 4 will suffice to describe the front and rear pin arrays 26*f* and 26*r* in the opposite end of handle 14** as well.

Figure 3:
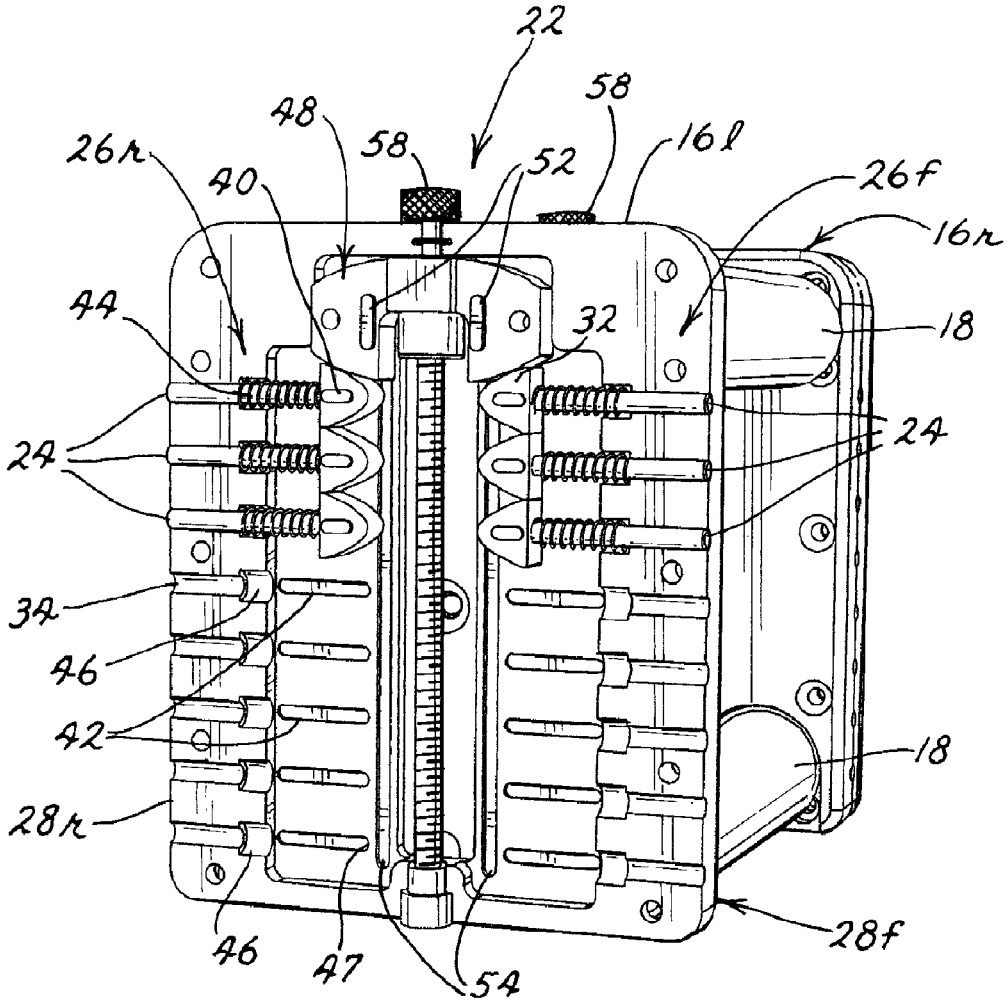
FIG. 3 is a perspective view of one end of the handle shown in FIG. 2 with a portion of the one end of the handle having been removed or broken away, particularly illustrating some of the connecting pins carried within the interior of that end of the handle with none of the connecting pins having been moved outwardly to their weight engaging positions.
Figure 4:
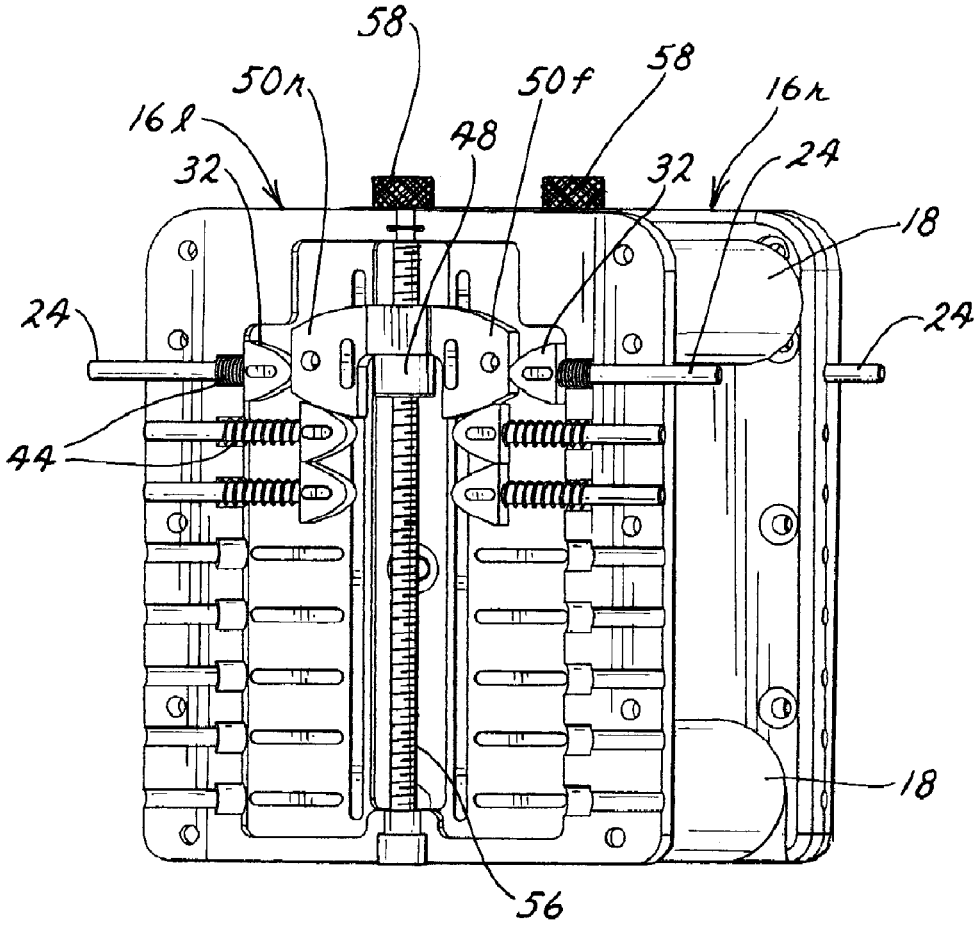
FIG. 4 is a perspective view similar to FIG. 3, but illustrating a first set of connecting pins having been moved outwardly to their weight engaging positions by a vertically movable cam actuator to thereby couple the first weight to the handle.

Referring now to FIG. 3, the front and rear pin arrays **26*f* and 26*r* and the structure and operation of pins 24 are similar to that disclosed in the Applicants' prior U.S. Pat. No. 7,520,845, which is also hereby incorporated by reference. However, in this invention, each front and rear pin array 26*f* and 26*r* is vertically oriented and contained within one of the ends 16 of handle 14, rather than being horizontally oriented and contained within a base of handle 14. Front pin array 26*f* acts through a front side 28*f* of handle end 16 and a rear pin array that acts through the rear side 28***r* of handle end 16. The number of pins 24 in each pin array 26*f* or 26*r* is equal to the number of nested weights 4 that are capable of being used with handle 14. Since dumbbell 2 herein is designed to have eight nested weights 4 that can be coupled to handle 14, there are eight connecting pins 24 in each of the front and rear pin arrays 26*f* and 26*r*. For simplicity sake, only the three upper connecting pins 24 are shown in FIGS. 3 and 4 in each pin array 26*f* and 26*r*.

Like the connecting pins shown in the 845 patent that has been incorporated by reference herein, each connecting pin 24 herein has an enlarged arrow shaped head 32 at one end thereof. Head 32 of pin 24 points to the inside of handle end 16 when pin 24 is received within a horizontal, circular guide bore 34 in handle end 16. For convenience in assembly, each handle end 16 is formed in substantially identical halves that abut one another along a parting line 36 and that are joined together by a plurality of fasteners 38 after front and rear pin arrays 26*f* and 26*r* have been assembled inside thereof. The interior of handle end 16 has been shown in FIG. 3 by removing the outermost half of handle end 16 and illustrating only the innermost half of handle end 16. Thus, only one semicircular half of guide bore 34 is shown in FIG. 3, the other unseen half of guide bore 34 being in the removed outermost half of handle end 16.

Each side of head 32 has an outwardly extending, horizontal guide tab 40 that moves within an adjacent horizontal guide slot 42 in handle end 16. A spring 44 surrounds pin 24 and bears between the back of head 32 of pin 24 and an annular abutment 46 formed by a stepped down shoulder in guide bore 34. Spring 44 normally biases pin 24 inwardly relative to handle end 16 until the inner end of tab 40 engages against an inner end 47 of guide slot 42. This holds pin 24 in an innermost and retracted weight disengaging position.

When pin 24 is in its retracted position, pin 24 is substantially wholly retracted into handle end 16 so that the outer tip of pin 24 does not significantly protrude outwardly through either front side 28*f* or rear side 28*r* of handle end 16 depending upon which pin array 26 one is talking about, i.e. either front pin array 26*f* or rear pin array 26*r*. Thus, if all pins 24 in both pin arrays 26*f* and 26*r* are in their retracted positions, handle 14 is not coupled to any of the nested weights 4. If the user were to pick up handle 14 with pins 24 disposed in their retracted positions, nothing would happen except that handle 14 would lift up out of gap 12. No weights 4 would rise with handle 14.

Selector 22 further includes a vertically movable, double lobed cam actuator 48 in each handle end 16. Cam actuator 48 has a front cam lobe 50*f* that bears progressively against heads 32 of pins 24 in front pin array 26*f*. Similarly, cam actuator 48 has a rear cam lobe 50*r* that bears progressively against heads 32 of pins 24 in rear pin array 26*r*. Cam actuator 48 is guided in its vertical movement by a pair of vertically extending guide tabs 52 on each side thereof. Tabs 52 are received in a pair of vertically extending guide slots 54 provided in handle end 16 adjacent each side of cam actuator 48. In this respect, tabs 52 and guide slots 54 are similar in structure and operation to tabs 40 and guide slots 42 for pins 24, but extending vertically rather than horizontally.

As cam actuator 48 is moved vertically within handle end 16, cam lobes 50 simultaneously contact the heads 32 of those pins 24 that are at the same vertical elevation in both pin arrays 26, i.e. any pair of pins 24 that are horizontally aligned with one another. This pushes outwardly on these pins 24 against the bias of springs 44 to cause shafts 30 of pins 24 to be extended outwardly through the front and rear sides 28*f* and 28*r* of handle end 16. In turn, this causes the outwardly protruded portions of this pair of pins 24 to be positioned in one of the spaces 9 beneath the ends of the front and rear side rails 8*f* and 8*r* of a particular weight 4 to thereby couple that weight 4, and inherently all weights 4 above it, to handle 14.

A vertically extending, rotatable shaft 56 has its top and bottom ends rotatably journalled in the top and bottom sides of handle end 16. Shaft 56 is threaded over most of its length and cam actuator 48 has a threaded connection to the threaded portion of shaft 56. An upper end 58 of shaft 56 is located on top of handle end 16 to be accessible to the user. Upper end 58 of shaft 56 has a tool receiving aperture 60, such as an Allen wrench type coupling, for allowing some type of torque applying tool (not shown) to be releasably received in aperture 60. When the torque applying tool is actuated, using either a motor as in a motorized drill or even by hand as in a hand operated Allen wrench, shaft 56 rotates within its journals in the top and bottom sides of handle end 6. This causes cam actuator 48 to travel down shaft 56 or up shaft 56 depending upon the direction of rotation of shaft 56. It is this vertical up and down motion of cam actuator 48 caused by the rotation of shaft 56 that causes cam lobes 50 on actuator 48 to progressively engage or disengage heads 32 of pins 24.

FIG. 3 shows cam actuator 48 in a raised position in which no pins 24 in either of the front and rear pin arrays 26*f* and 26*r* have been moved outwardly. All pins 24 are shown in FIG. 3 in their weight disengaging positions in which pins 24 are retracted substantially within handle ends 6.

Let's assume that the user desires to couple only the first innermost weight 4 to handle 14. To do so, the user applies a suitable tool to tool receiving aperture 60 on shaft 56 and turns shaft 56 until cam actuator 48 moves downwardly to the position shown in FIG. 4. In this position, cam lobes 50 on cam actuator 48 have cammed the uppermost connecting pin 24 in each pin array outwardly 26*f* and 26*r* outwardly as depicted in FIG. 4. Biasing springs 44 are further compressed by the outward movement of pins 24 with guide tabs 40 sliding outwardly within guide slots 42 until tabs 40 engage the outer ends 47 of slots 42. The outwardly protruded portions of the uppermost pair of connecting pins 24 are thus extended out into the spaces beneath the adjacent ends of the uppermost side rail 8. The user must then make the same adjustment to the uppermost pair of pins 24 on the other handle end 16.

Note that in FIG. 4, the uppermost connecting pins 24 on both handle ends 16 are shown in their outwardly protruded, weight engaging positions. Thus, four connecting pins 24 are extended out of handle 14 all at the same vertical elevation and extending beneath opposite left and right ends of both of the uppermost side rails 8*f* and 8*r* of the innermost weight 4. When the user picks up handle 14 after so adjusting pins 24, the innermost weight 4 is lifted by handle 14 by means of the four connecting pins 24 lifting up on the side rails 8*f* and 8*r* of the innermost weight 4 immediately inboard of where side rails 8 connect to weight plates 6. Thus, only the first innermost weight 4 is connected to handle 14 when only the uppermost connecting pins 24 in the front and rear pin arrays 26*f* and 26*r* are extended as shown in FIG. 4.

The user can progressively add more weight to handle 14 by moving cam actuator 48 further downwardly to actuate pins 24 for the other weights 4. Let's suppose the user wants to pick up three weights 4 and not just one weight 4. If that were the case, the user would actuate shaft 56 until cam actuator 48 engages the pins 24 that are third from the top in the vertical arrays 26 of pins, i.e. the lowermost connecting pins 24 that are shown in FIG. 4. In that event, all of the corresponding connecting pins 24 at this vertical location will be protruded outwardly (and the uppermost connecting pins of the first weight will be retracted after cam actuator 48 moves down past them) such that the protruded portions of pins 24 will be received in the spaces 9 beneath the side rails 8 of the third nested weight 4. Then, when the user picks up handle 14, the first three weights 4 will be coupled to handle 14 since the third weight 4 and the two weights above it will rise with handle 14.

The user can pick up any desired number of weights, up to the maximum number of nested weights contained in the original set of nested weights, simply by positioning cam actuator 48 at the appropriate spot in the vertical pin arrays. If all eight weights are desired for use, the user moves cam actuator 48 down until the protruding portions of pins 24 are beneath the side rails 8 of the outermost weight as is the case when the very lowermost connecting pins in pin 24 arrays have been extended out of the front and rear sides of handle ends 6.

As noted previously, selector 22 disclosed herein is one in which all the basic components are carried in the ends of handle 14 of dumbbell 2. To speed the movement of cam actuator 48, a tool receiving aperture 60 is contained in upper end 58 of the rotatable adjustment shaft 56 to allow an electric drill or other power operated tool to be coupled to shaft 56 for quickly rotating shaft 56. However, shaft 56 could also have a knurled upper end 58 which would allow manual turning by hand. Thus, the problem of a lost or misplaced connecting pin is overcome since pin arrays 26 are captured and held within the ends 16 of handle 14 after the ends of handle 14 have been assembled with pin arrays 26 inside the ends.

In addition, it is relatively easy to use and adjust the weight of dumbbell 2. All the user need do is to rotate shaft 56 and watch pins 24 progressively extend out and then retract until the user gets to the vertical locations of the pins 24 that extend out beneath the side rails 8 of the lowermost weight the user wants to couple to handle 14. When the user sees this happen, e.g. pins 24 slide out beneath the side rails of the fourth weight 4 and the user wants four weights to be coupled to handle 14 as shown in FIG. 1, the user can stop rotating shaft 56. The user then does the same thing on the other end of handle 14 to extend the corresponding connecting pins 24 on the other end of handle 14. After this is done on both ends of handle 14, handle 14 will then carry the innermost four weights 4 with it when the user picks up handle 14 and uses dumbbell 2.

Cam lobes 50 of cam actuator 48 can be sized to extend only the pins 24 at a given vertical elevation so that pins 24 are projected outwardly into a single space 9 beneath the side rails of a single weight 4. In this case, the four outwardly protruded pins 24 will bear the entire mass being carried by handle 14, whether one weight 4 is coupled to handle 14 or all eight weights 4 are coupled to handle 14. Alternatively, cam lobes 50 could be long enough to simultaneously engage the pins 24 of two vertically adjacent sets of pins 24 so that pins 24 are projected outwardly into two vertically adjacent spaces 9. In this case, a total of eight pins 24 will bear the mass coupled to handle 14, thereby giving an additional measure of safety and security.

Figure 5:
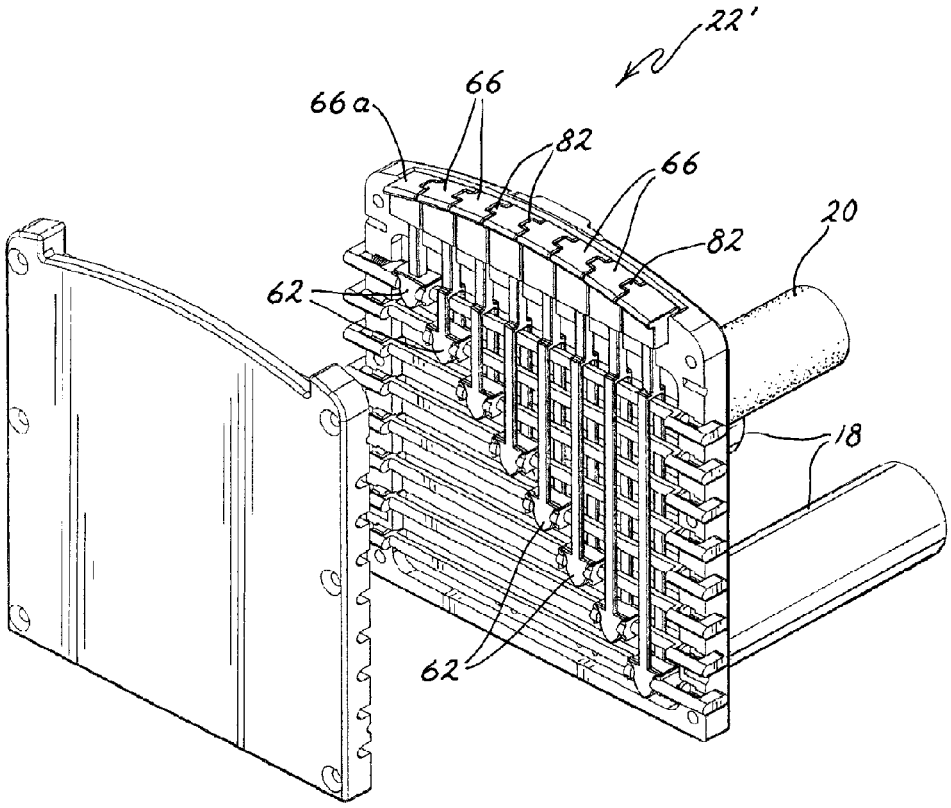
FIG. 5 is a perspective view of one end of a second embodiment of a handle for use with the dumbbell of FIG. 1, particularly illustrating a portion of the one end of the handle having been exploded away to illustrate the connecting pins carried within the interior of that end of handle with none of the connecting pins having been moved outwardly to their weight engaging positions.
Figure 6:
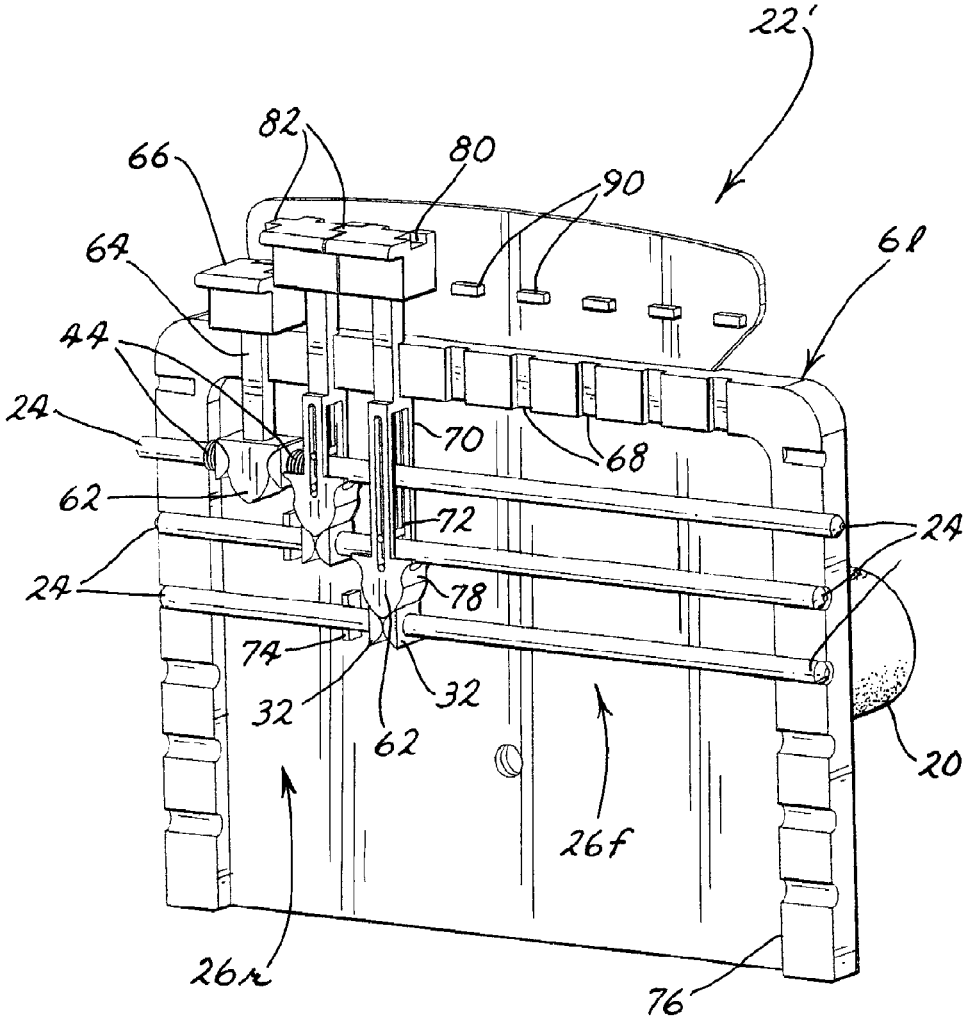
FIG. 6 is a perspective view similar to FIG. 5, but illustrating a first set of connecting pins having been moved outwardly to their weight engaging positions by a vertically movable key to couple the first weight to the handle.

Referring to FIGS. 5 and 6, a second embodiment of a selector for dumbbell 2 is illustrated generally as 22'. In this embodiment, each handle end 16 will still include front and rear pin arrays **26*f* and 26*r* that are similar to pin arrays 26*f* and 26*r* in the first embodiment. Pin arrays 26 will comprise a plurality of vertically spaced connecting pins 24 with each pin 24 having an enlarged arrow shaped head 32 at one end. Each pin 24 in each pin array 26 will be biased inwardly relative to handle end 16 by a spring 44 acting on head 32 of each pin. Thus, pins 24 in pin arrays 26 are normally retracted into handle end 16 so that no weights 4** are coupled to the handle.

Referring to FIG. 6 and looking at the uppermost pin 24 in each of the front and rear pin arrays, one can see that there is a difference in the length of the pins 24. The uppermost pin 24 in the front pin array **26*f* is very long, the uppermost pin 24 in the rear pin array 26*r* is very short by comparison, and consequently the abutting interface between the enlarged heads 32 of these two connecting pins 24 is located close to the rear side of handle end 16. Together, the lengths of both pins 24 collectively extend across the width of handle end 16 so that the tips of pins 24 are substantially flush with the front and rear sides of handle end 16 when the heads 32 of pins 24** abut with one another.

As one proceeds vertically downwardly in handle end 16 from one pair of connecting pins 24 to the next, one can see that the collective length of each pair of pins 24 is always the same, namely the collective length spans across the width of handle end 16 between the front and rear sides of the handle end 16. However, the relative proportions of the lengths of the pins vary from one pair of pins to the next such that the abutting interface between heads 32 of pins 24 gets progressively horizontally shifted relative to the width of handle end 16. For example, looking at the pair of pins 24 immediately below the uppermost pair of pins 24, pin 24 that extends through the front side is now shorter than in pin 24 immediately above it while pin 24 that extends through the rear side is now longer than in pin 24 immediately above it. This locates the abutting interface between the heads 32 of these two pins 24 immediately to one side of the abutting interface for the heads 32 of the two pins 24 above them. This continues in like manner from one pair of pins to the next. Accordingly, the abutting heads 32 of each pair of pins 24 are positioned to be horizontally offset relative to the abutting heads 32 of the other pins 24 in a stair step manner. See FIG. 5.

Each pair of pins 24 in pin arrays 26, namely pin 24 that extends through the front side of handle end 16 and pin 24 that is at the same vertical elevation and that extends through the rear side of handle end 16, is now actuated by its own individual downwardly pointing, arrow shaped, double lobed cam actuator 62. Cam actuator 62 for each pair of pins 24 is attached by a stem 64 to the underside of a vertically movable key 66 that is disposed in a row of such keys 66 on the top side of handle end 16. The row of such keys 66 is externally exposed on the top side of handle end 16 with stem 64 of each key passing down through an opening 68 on the top side of handle end 16 such that cam actuator 62 is located in the interior of handle end 16 adjacent the abutting interface between the heads 32 for that pair of connecting pins 24 which such cam actuator 62 is meant to actuate. Because these abutting interfaces are vertically offset relative to one another, stems 64 of the various keys 66 are progressively longer from one side of handle end 16 to the other side, as shown in FIG. 6. In addition, because the abutting interfaces are also horizontally offset relative to one another, the keys 66 are horizontally offset relative to one another much like a row of trumpet keys on a trumpet. See FIG. 5.

Except for the shortest stem 64 of key 66 shown to the extreme left in FIG. 6, which stem 64 is solid, stems 64 of keys 66 include a slotted guide portion 70 which receives a fixed guide pin 72 located in handle end 16. Guide pin 72 and its reception in slotted guide portion 70 helps guide and stabilize the vertical motion of those keys 66 with stems 64 that are progressively longer than the single key 66 with the shortest and solid stem 64. Biasing springs 44 acting on heads 32 of pins 24 seat against different members depending upon which pair of pins one is talking about. For pins 24 that extend through the rear side of handle end 16, each biasing spring 44 is seated at one end against the enlarged head of pin 24 and at the other end against a fixed abutment or flange 74 in handle end 16. For pins 24 that extend through the front side of handle end 16, each biasing spring 44 is seated at one end against the enlarged head of pin 24 and at the other end against one side of stem 64 of the adjacent key (except for the very lowermost pin 24 extending through the front side of handle end 16 which will have the other end of spring 44 thereof abutting against the inside surface 76 of the wall that defines the front side of handle end 16).

Cam actuators 62 and keys 66 will actuate the pair of pins controlled thereby in a bi-stable manner like that disclosed and described in the 845 patent incorporated by reference herein. One difference is that each key 66 in FIG. 6 operates by being vertically depressed to actuate the pair of pins which are reached by cam actuator 62 of that key rather than being pivotally moved as in the 845 patent. When such key 66 is depressed, as shown by key 66 at the extreme left in FIG. 6, cam actuator 62 moves down through the abutting interface between heads 32 of pins 24 to spread pins 24 apart and to project the outermost portions of pins 24 outwardly through the front and rear sides of handle end 16 to extend into one of the spaces 9 underneath the side rails 8 of one of the nested weights 4. Biasing springs 44 will then cause heads 32 to lock into detents 78 on either side of cam actuator 62 to hold key 66 in this operative position. To release key 66, the user can put a fingernail or the like beneath a lip on key 66 and pull up. As heads 32 come out of detents 78 and reseat against the arrow shaped cam lobes on cam actuator 62, springs 44 then act on the cam lobes of cam actuator 62 to bias key 66 back into its raised, non-actuated position.

Each key 66 has a recess 80 in the top surface thereof which receives a finger or tab 82 on that key 66 immediately to the right thereof in the row of keys shown in FIGS. 5 and 6. This recess 80 and tab 82 interconnection between keys 66 forms an interlock system between keys 66 so that depressing key 66 for any weight other than the innermost weight will simultaneously cause keys 66 for the weights 4 above the selected weight to also be depressed. For example, pushing down on the fourth key shown in FIG. 5 as to couple the first four nested weights to the handle will also push down on the three keys 66 to the left of the fourth key. Thus, pins 24 in the uppermost four pairs of pins will all be extended out through the front and rear sides of handle end 16. This avoids having to push each key sequentially and individually. If it takes too much finger force to have the interlock system easily extend the desired pins, the interlock system allows pins 24 to be extended in discrete groups. For example, if the user wants to select all eight weights, he or she might first push down on the fourth key 66 to actuate the first four pairs of pins 24 and then on the last or eighth key 66 to actuate the remaining pins 24.

Handle end 16 may include guide tabs 90 that coact with grooves (not shown) on the back side of keys 66 to help vertically guide keys 66 up and down as they are depressed or released. Keys 66 are held in their lowered or actuated position by virtue of heads 32 of the connecting pins engaging the detents 78 in cam actuator 62 and being held in such detents 78 by the bias of springs 44. Keys 66 are held in their raised, non-operative position by virtue of the top of cam actuator 62 or the top of the slotted guide portion 70 in stem 64 coming into abutment with the underside of the wall that defines the top of handle end 16. See FIG. 6 which shows the two slotted guide portions 70 for the second and third keys 66 having this abutting engagement with the underside of the wall that defines the top of handle end 16, thus preventing further upward movement of keys 66. The first key 66 shown at the extreme left in FIG. 6 would normally have the top of cam actuator 62 in this abutting, upward motion limiting engagement since the first key 66 lacks a slotted guide portion 70. However, this is not shown in FIG. 6 since the first key 66 is shown in its depressed rather than raised position.

In the embodiment of the selector shown in FIGS. 5 and 6, the numbers of the pairs of pins 24 that are extended into a weight bearing relationship correspond to the number of weights 4 that are coupled to the handle. If four weights are to be coupled such that the first four keys 66 on the left of the handle end 16 are depressed, then the uppermost four pairs of pins 24 are extended out into the spaces 9 beneath the side rails 8 of the first four nested weights. Thus, the load is shared by many different pins, thereby allowing pins 24 to individually have somewhat less strength than would otherwise be required.

The selector shown in FIGS. 5 and 6 obviously has many of the same advantages as that shown in FIGS. 1-4. The selector has the vertically disposed pin arrays **26*f* and 26*r* permanently carried in each handle end 16. The pins arrays 26 are not prone to being lost since the user will have pin arrays 26 if the user has handle 14. Like the first embodiment of the selector, there is also no lower base or bottom member on handle 14 that would tend to hit or bump against the user's knuckles when the user is gripping hand grip 20, i.e. there is no structure directly beneath hand grip 20. Finally, in the second embodiment of the selector, pin arrays 26*f* and 26*r* are easily activated merely by pushing down on one or more of keys 66** without the need for a torque applying tool and without having to turn a rotatable member.

Keys 66 are preferably arranged in each of the handle ends so that the user pushes down on that key in each handle end that has the same relative position in the row of keys in order to extend the pins 24 out beneath the rails of a selected weight. For example, referring to FIG. 5, to select the innermost weight in the series of nested weights, the user will push down on the key 66 that is also labeled as **66*a* in FIG. 5, which key 66*a* is shown on the far side of the row of keys 66 in the perspective view of FIG. 5. In the other handle end (not shown), the same identical key 66*a* on the far side of the row of keys 66** will be depressed to select the innermost weight in the series of nested weights. This helps avoid confusing the user since he or she will naturally push down on the same key in each row of keys when trying to select a particular weight for use on the dumbbell.

In addition, identifying indicia could be placed or molded into the tops of the keys to help instruct the user as to which keys 66 to depress. For example, if the weight of the dumbbell can be adjusted in 10 pound increments, the keys **66*a* could each be labeled with the number "10" to indicate 10 pounds, the next pair of keys 66** could be labeled with the number "20" to indicate 20 pounds, and so on. Alternatively, the keys could be color coded.

As a further alternative, the keys 66 could be disposed in a reversed relationship in the different handle ends such that the keys **66*a* for selecting the innermost weight would be on opposite sides of the row of keys 66. One key 66*a* would be on the far side as shown in FIG. 5 while the other key 66*a* would be on the near side. In this case, the presence of distinguishing indicia on top of the keys 66** to instruct the user as to which keys to push would be particularly helpful.

Various modifications of this invention will be apparent to those skilled in the art. For example, the cross-sectional configuration of pins 24 can be circular as shown in FIGS. 1-4 and 6 or the tips of pins 24 could have a generally rectangular cross-sectional configuration as shown in FIG. 5. All of the pins 24 are shown in their extended positions in FIG. 5. Accordingly, the scope of this invention is to be limited only by the appended claims.

We claim:

1. A selectorized dumbbell, which comprises:

(a) an array of nested weights comprising a stack of nested left weight plates and a stack of nested right weight plates;

(b) a handle having a left end and a right end with the handle ends extending substantially perpendicularly relative to a hand grip of the handle and with the handle ends also being disposed substantially parallel to the weight plates; and (c) a selector for coupling selected numbers of left weight plates to the left end of the handle and selected numbers of right weight plates to the right end of the handle, wherein the selector comprises a plurality of connecting pins on each of the left and right ends of the handle, wherein the connecting pins are vertically spaced apart from one another in each of the handle ends in a vertically spread apart pin array and are horizontally movable between a weight coupling position in which the connecting pins are extended outwardly relative to the handle ends and a weight uncoupling position in which the connecting pins are retracted inwardly relative to the handle ends, and wherein the connecting pins move in a direction that is substantially perpendicular relative to the hand grip and substantially parallel relative to the handle ends as the connecting pins move back and forth between their weight coupling and weight uncoupling positions.

2. A selectorized dumbbell, which comprises:

(a) a plurality of individual weights that can be nested together to provide a left stack of nested left weight plates and a right stack of nested right weight plates that are separated by a gap;

(b) a handle having a hand grip extending along an axis with the handle further having opposite left and right ends joined to opposite ends of the hand grip with the left and right ends of the handle extending perpendicularly to the hand grip, wherein the handle may be dropped down into the gap between the stacks of nested left and right weight plates with the left end of the handle being adjacent an innermost left weight plate in the left stack of weight plates and the right end of the handle being adjacent an innermost right weight plate in the right stack of weight plates;

(c) wherein each weight comprises a left weight plate and a right weight plate that are spaced apart but joined to one another by a front rail extending between front sides of the weight plates and a rear rail extending between rear sides of the weight plates, the weight plates and front and rear rails of each weight being separate and distinct from the weight plates and front and rear rails of the other weights and from the handle, wherein the front and rear rails of any given weight are located at a substantially identical vertical elevation relative to one another with the front and rear rails of different weights being located at different vertical elevations relative to one another such that the front and rear rails of all the weights overlie one another in vertically spread apart front and rear rail arrays with a vertical space being provided underneath each rail in the rail arrays, and wherein the front and rear rails of each weight differ in length from the front and rear rails of the other weights such that the weight plates of different weights are spaced apart at progressively greater distances, wherein the different elevations and different lengths of the front and rear rails on different weights allow the left and right weight plates to be nested with respect to one another in their respective left and right stacks;

(d) a selector that connects a desired number of weights to the handle, wherein the selector comprises (i) a front pin array and a rear pin array in each of the left and right ends of the handle, wherein each pin array has a plurality of connecting pins equal in number to the number of rails in the front and rear rail arrays, and wherein the pins are vertically spaced apart in each of the handle ends in a manner that matches the spacing of the vertical spaces in the rail array but with the pins being vertically offset relative to the vertical spaces such that the pins in the pin arrays are projectable out from the handle ends into the spaces under the rails in the rail arrays; and (ii) wherein the pins in each of the front and rear pin arrays are horizontally movable relative to the handle ends from a retracted position in which the pins are located inwardly relative to the handle ends to be clear of the spaces under the rails in the rail arrays to an extended position in which the pins are extended outwardly relative to the handle ends into the spaces under the rails in the rail arrays.

3. The selectorized dumbbell of claim 2, further including an actuator carried in each of the left and right handle ends for moving the pins between their retracted and extended positions.

4. The selectorized dumbbell of claim 3, wherein the vertically spaced pins in the front and rear pin arrays are disposed in corresponding pairs of pins with each corresponding pair of pins comprising a selected pin from the front pin array and a pin from the rear pin array that is at an identical vertical elevation to the selected pin from the front pin array, and wherein the actuator moves any corresponding pair of pins in the pin arrays from their retracted to extended positions by simultaneously moving the pins in the corresponding pair of pins horizontally away from one another.

5. The selectorized dumbbell of claim 4, wherein the actuator in each handle end is a single vertically movable member that travels up and down the handle end to move no more than two pairs of vertically adjacent corresponding pairs of pins into their extended positions at one time with the particular pairs of pins that are moved into their extended positions by the actuator varying depending upon the vertical position of the actuator relative to the handle end.

6. The selectorized dumbbell of claim 5, wherein the actuator in each handle end is sized to move only one corresponding pair of pins into their extended positions at one time.

7. The selectorized dumbbell of claim 5, wherein the actuator in each handle includes a rotatable, vertically extending, actuator shaft in the handle end having its top and bottom ends rotatably journalled in the top and bottom sides of the handle end and with the top end of the rotatable actuator shaft being accessible from above the top side of the handle end, and wherein the vertically movable member of the actuator is threaded onto a threaded portion of the actuator shaft such that the vertically movable member vertically travels up and down as the actuator shaft is rotated.

8. The selectorized dumbbell of claim 7, wherein the top end of the actuator shaft includes an aperture for receiving a torque applying tool to help rotate the actuator shaft.

9. The selectorized dumbbell of claim 7, wherein the top end of the actuator shaft is knurled and is large enough to allow an operator to manually rotate the shaft.

10. The selectorized dumbbell of claim 7, wherein the vertically movable member and the actuator shaft of the actuator are enclosed within the handle end except for the top end of the actuator shaft which is accessible to the operator.

11. The selectorized dumbbell of claim 10, wherein the top end of the actuator shaft sits atop the top side of the handle end.

12. The selectorized dumbbell of claim 4, wherein the actuator in each handle end comprises a plurality of vertically movable members corresponding to the number of corresponding pairs of pins with each pair of pins being moved between their retracted and extended positions by a different vertically movable member.

13. The selectorized dumbbell of claim 12, further including a plurality keys located on a top side of the handle with the number of keys corresponding to the number of vertically movable members of the actuator, and wherein each vertically movable member for each corresponding pair of pins is attached to a different key.

14. The selectorized dumbbell of claim 13, wherein the plurality of keys are disposed in a row on the top side of the handle end extending substantially across the width of the handle end.

15. The selectorized dumbbell of claim 13, wherein each key can be depressed downwardly relative to the handle end to slide the vertically movable member attached thereto downwardly to move the corresponding pair of pins apart to dispose them in their extended positions.

16. The selectorized dumbbell of claim 14, wherein each key is attached to its vertically movable member by an elongated stem, and wherein the stems of at least some of the keys have vertically slotted guide portions that ride on horizontal guide pins carried on the handle end.

17. A selectorized dumbbell, which comprises:

(a) an array of nested weights comprising a stack of nested left weight plates and a stack of nested right weight plates;

(b) a handle having a left end and a right end with the handle ends extending substantially perpendicularly relative to a hand grip of the handle and with the handle ends also being disposed substantially parallel to the weight plates; and (c) a selector for coupling selected numbers of left weight plates to the left end of the handle and selected numbers of right weight plates to the right end of the handle, wherein the selector comprises a plurality of connecting pins on each of the left and right ends of the handle, wherein the connecting pins are vertically spaced apart from one another in each of the handle ends in a vertically spread apart pin array and are horizontally movable between a weight coupling position in which the connecting pins are extended outwardly relative to the handle ends and a weight uncoupling position in which the connecting pins are retracted inwardly relative to the handle ends, and wherein the connecting pins are substantially enclosed inside of the handle ends to be substantially housed within the handle ends when the connecting pins are retracted into their weight uncoupling positions.

* * * * *